US005120077A

United States Patent [19]

Belli

[11] Patent Number: 5,120,077

[45] Date of Patent: Jun. 9, 1992

[54] GAME DEVICE AND METHOD OF PLAYING LIMBO

[76] Inventor: John A. Belli, 190 Will Thompson's Way, Fitchburg, Mass. 01420

[21] Appl. No.: 344,533

[22] Filed: Apr. 25, 1989

Related U.S. Application Data

[63] Continuation of Ser. No. 108,375, Oct. 14, 1987, abandoned.

[51] Int. Cl.[5] ..... A63B 71/04; A63B 1/00

[52] U.S. Cl. ..... 273/444; 273/459; 248/87; 482/17

[58] Field of Search ..... 273/1 G, 1 GC, 1 L, 273/444, 459; 272/1 B, 74, 101-103; 248/75, 80-87

[56] References Cited

U.S. PATENT DOCUMENTS

| | | | |
|---|---|---|---|
| 631,317 | 8/1899 | Miller | 248/87 |
| 858,883 | 7/1907 | Lindsay | 248/80 |
| 1,385,472 | 7/1921 | Renn | 248/86 |
| 2,440,745 | 5/1948 | Hauck | 248/81 |
| 3,801,096 | 4/1974 | Miller | 272/102 X |

*Primary Examiner*—Paul E. Shapiro
*Attorney, Agent, or Firm*—Pandiscio & Pandiscio

[57] ABSTRACT

A limbo game device and method of amusement for testing the flexibility of and balance of the players. Each player is required to pass beneath a horizontal stream of water. All successful players, those who remain dry, then make an additional pass beneath the stream of water which has been lowered relative to the ground. The height of the stream of water is successively lowered until only one player remains dry.

6 Claims, 1 Drawing Sheet

GAME DEVICE AND METHOD OF PLAYING LIMBO

This is a continuation of U.S. patent application Ser. No. 108,375, filed Oct. 14, 1987, and now abandoned.

FIELD OF THE INVENTION

This invention relates to amusement devices or games in general, and more particularly to games of skill requiring each player to exhibit increasing amounts of flexibility and balance as the game progresses.

BACKGROUND OF THE INVENTION

The game of limbo, in which the players take turns passing under a horizontal bar, is well known. In limbo, the bar is set at a first height and then each player is required to pass beneath the horizontal bar. The players are required to make their pass beneath the bar while leaning backwards with only their feet touching the ground. A player who knocks the horizontal bar so that it falls on the ground, or uses his hands or knees to assist him in successfully passing beneath the bar, is disqualified from the game. The bar is then set to a lower height and the process is repeated. This goes on until only one player remains. The remaining player is the game's winner.

Limbo can be very entertaining and amusing. However, often the game drags on and players become disinterested after they drop out of the competition. Delay in replacing the bar to the correct height after it falls to the ground contributes to the game's length.

OBJECTS OF THE INVENTION

The primary object of the present invention is to provide an improved game device and method of playing limbo which keeps the interest of the players high even after the players have fallen out of the competition.

Another object of the present invention is to supply additional incentive for a player to successfully complete his turn when playing limbo and to create an additional interest in observing unsuccessful passes of the other players.

Still another object of the present invention is to supply a means for recording which portion of the player's anatomy prevented him from successfully completing his turn.

A further object of the present invention is to provide a limbo game with a horizontal member that does not need to be reset each time a player makes an unsuccessful pass beneath it.

Another object of the present invention is to provide a limbo game in which a player will be wet with water when he fails to successfully pass beneath the game's horizontal member.

Yet another object of the present invention is to provide a limbo game in which a player will be wet with water when he fails to successfully pass beneath the game's horizontal member, but wherein the player will wet only that portion of his anatomy that contacts the game's horizontal member.

An additional object of the present invention is to provide limbo game apparatus which achieves the foregoing objectives and which is designed to be easy to manufacture and assemble and can be quickly adjusted to the proper height.

Still another object of the present invention is to provide a novel method of playing limbo.

SUMMARY OF THE PRESENT INVENTION

These and other objects of the present invention are achieved by an improved game device and method of playing limbo wherein the game's traditional horizontal bar is replaced by water means for producing a substantially horizontal stream of water, and wherein the limbo game is played by having players pass beneath the horizontal stream of water.

BRIEF DESCRIPTION OF THE DRAWINGS

Still other objects and features of the present invention will be more particularly described or rendered obvious in the following detailed description of the invention, which is to be considered together with the accompanying drawing wherein like numbers refer to like parts and further wherein.

DETAILED DESCRIPTION OF THE INVENTION

Figure 1:
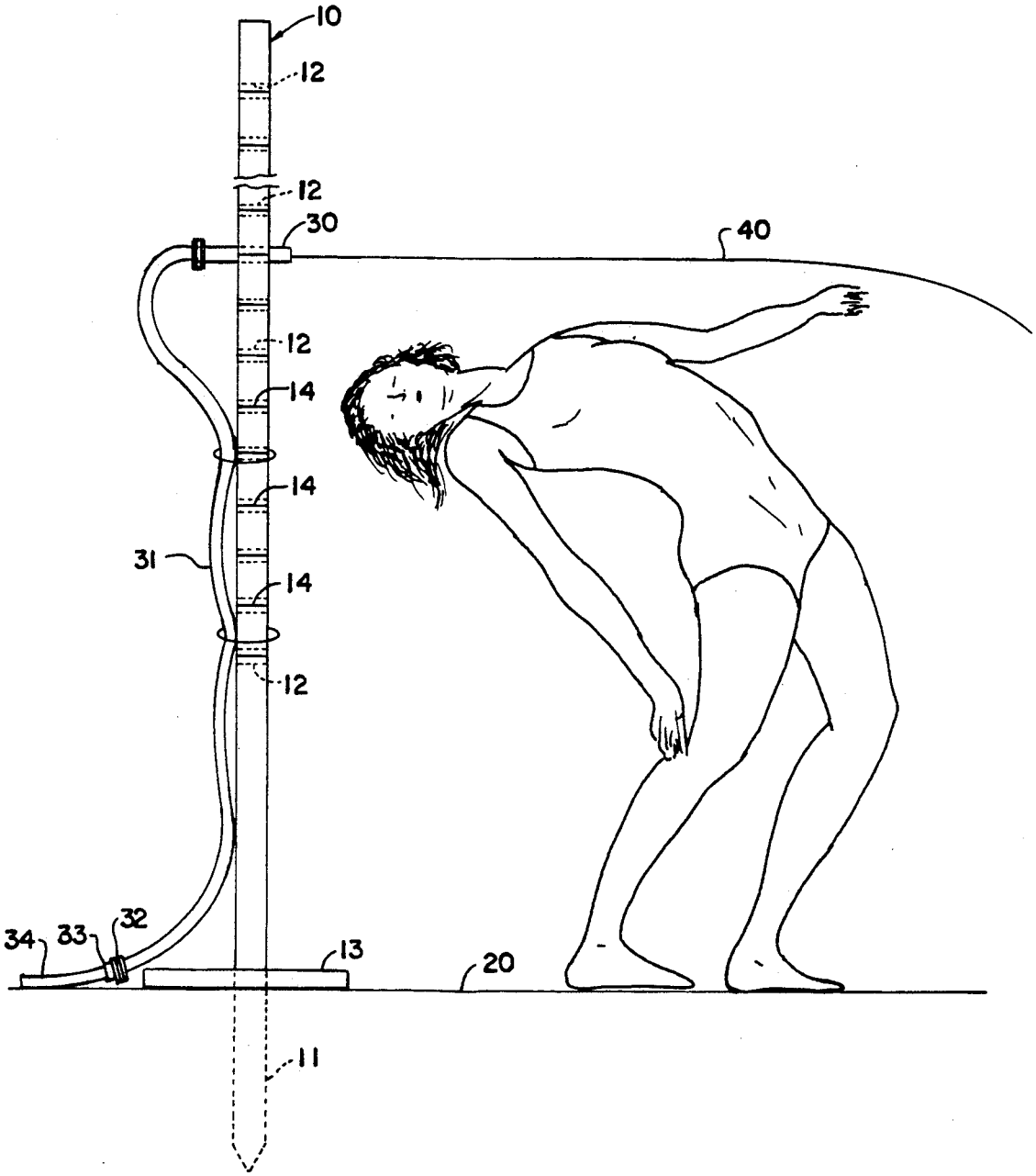
FIG. 1 is a representative view showing the preferred embodiment of the present invention.

Looking now at FIG. 1, there is shown the preferred embodiment of the present invention. More particularly, there is shown a pole 10 which is oriented vertically and has a pointed end 11 which is positioned in ground 20. Pole 10 also has a plurality of horizontal feet 13 which extend perpendicularly away from the pole, parallel to ground 20, and which serve to help stabilize the pole in the ground.

Pole 10 has a series of holes 12 extending completely therethrough for receiving a nozzle 30. Pole 10 also has a plurality of ruled markings 14 which indicate the height of holes 12 above the ground 20. Holes 12 receive nozzle 30 and are designed to hold the nozzle substantially horizontal.

Nozzle 30 is connected to the upper end of a limbo hose 31 which is of sufficient length to allow the nozzle to be positioned in any of the holes 12. The lower end of hose 31 has a female connector 32 designed to receive the male end 33 of a garden hose 34. Garden hose 34 is connected to a source of water (not shown) and the water travels through garden hose 34, up limbo hose 31, and out nozzle 30. Nozzle 30 is adapted to produce a thin (e.g. a pin-hole sized) stream of water which exits the nozzle substantially horizontal and which has sufficient pressure so that the stream of water will flow substantially horizontally away from the pole for at least several feet before the force of gravity draws the stream to earth. In this way the horizontal portion of the water stream can be used as a limbo bar, as will hereinafter be described in further detail. If desired, a bucket or other means (not shown) may be used to collect the water as it falls toward the ground; however, it is envisioned that this game apparatus will be used in areas where collection of the spent water is unnecessary, e.g. outside areas.

During play, the nozzle 30 is first positioned in the highest hole 12 that is less than the height of the tallest game player. Since this game can be safely enjoyed by both child and adult alike, the starting hole may be substantially higher than the shortest player.

After positioning the nozzle in the foregoing manner, the water is turned on and a horizontally-extending stream of water 40 is created at the preselected height. Each of the players then tries to pass beneath the water stream, leaning backwards so as to avoid getting wet. Music from a radio or cassette player may also be used to set a rhythm for the players to dance to as they pass beneath the stream of water. A strobe light may also be employed for game play after dark.

Once each player has tried to pass beneath the water stream, the nozzle is removed from its present hole in the pole and is repositioned one hole lower. The players who successfully passed beneath the horizontal water stream without getting wet are then entitled to try the next pass beneath the now-lowered water stream.

The process of passing beneath the water stream and then lowering the nozzle one position lower is repeated over and over again until only one player remains. This player is declared the winner.

It is to be appreciated that ruled markings 14 supplied on the pole allow the players to note at what height they were disqualified from further play, and also allow the players to compare their performance from one game to the next.

It is also to be appreciated that certain changes may be made to the preferred embodiment described above without departing from the scope of the present invention.

Thus, for example, it is anticipated that the pole's pointed end 11 might be omitted and pole 10 terminated in a blunt end approximately aligned with horizontal feet 13, whereby pole 10 could be positioned on asphalt or concrete. Alternatively, where the pole is to be used in relatively firm ground 20, horizontal feet 13 might be omitted.

Furthermore, a clamp might be used to attach nozzle 30 to vertical pole 10, rather than holes 12. Any of the many known clamps will work, provided they keep the nozzle horizontal.

It is also anticipated that one might use a clamp to mount nozzle 30 to some preexisting vertical member, e.g. a telephone pole or tree, in which case pole 10 might be eliminated entirely.

Finally, it is to be understood that the foregoing description is intended to be illustrative only. The scope of the present invention is indicated by the broad general meaning of the terms in which the appended claims are expressed.

Advantages of the Present Invention

Numerous advantages are achieved by using the present invention.

First, the present invention provides an improved game device and method of playing limbo which keeps the interest of the players high even after the players have fallen out of the competition.

Second, the present invention provides additional incentive for a player to successfully complete his turn when playing limbo and creates additional interest in observing unsuccessful passes of the other players.

Third, the present invention provides a means for recording which portion of the player's anatomy prevented him from successfully completing his turn.

Fourth, the present invention provides a limbo game with a horizontal member that does not need to be reset each time a player makes an unsuccessful pass beneath it.

Fifth, the present invention provides a limbo game in which a player will be wet with water when he fails to successfully pass beneath the game's horizontal member.

Sixth, the present invention provides a limbo game in which a player will be wet with water when he fails to successfully pass beneath the game's horizontal member, but wherein the player will wet only that portion of his anatomy that contacts the game's horizontal member.

Seventh, the present invention provides a limbo game apparatus which is designed to be easy to manufacture and assemble and can be quickly adjusted to the proper height.

And eighth, the present invention provides a novel method of playing limbo.

What is claimed is:

1. A method for playing limbo, said method comprising the steps of:

(1) providing (a) water means for producing a stream of water, and (b) support means for supporting said water means above the ground, with said water means being oriented so that said stream of water will extend substantially horizontally, and said support means being adjustable so that the height of said stream of water above said ground may be adjusted, (2) setting said water means at a first height above the ground, (3) requiring each player to try to pass beneath said stream of water without getting wet, (4) lowering said water means to a lower height, (5) requiring each player who successfully passed beneath said stream of water without getting wet to try to pass beneath the now-lower stream of water; and (6) repeating steps 4 and 5 above until only one player remains dry.

2. A method according to claim 1 wherein said method further comprises providing music means for supplying musical background as each player passes beneath a stream of water.

3. A method according to claim 1 wherein said water means is adapted to produce a pin-hole sized stream of water which will exit said water means at a sufficient pressure so that when said pin-hole sized stream of water is directed in a horizontal direction, said pin-hole sized stream of water will extend in a substantially horizontal direction for a length of at least several feet before the force of gravity draws said pin-hole sized stream of water downward to the ground, and further wherein said support means is adapted to support said water means above said ground so that said water means is oriented so that said pin-hole sized stream of water is directed in a horizontal direction.

4. A limbo game device comprising:

water means for producing a stream of water, support means for supporting said water means above the ground, with said water means being oriented so that said stream of water will extend substantially horizontally, and said support means being adjustable so that the height of said stream of water above said ground may be adjusted, and music means for supplying music.

5. A limbo game device comprising:

water means for producing a pin-hole sized stream of water which will exit said water means at a sufficient pressure so that when said pin-hole sized stream of water is directed in a horizontal direction, said pin-hole sized stream of water will extend in a substantially horizontal direction for a length of at least several feet before the force of gravity draws said pin-hole sized stream of water downward to the ground, and support means for supporting said water means above said ground, with said water means being oriented so that said pin-hole sized stream of water is directed in a horizontal direction, and said support means being adjustable so that the height of said pin-hole sized stream of water above said ground may be adjusted, wherein said support means comprises a vertical member and positioning means for attaching said water means to said vertical member, and further wherein said vertical member has ruled markings thereon to indicate the height of said pin-hole sized stream of water above the ground.

6. A limbo game device comprising:

water means for producing a pin-hole sized stream of water which will exit said water means at a sufficient pressure so that when said pin-hole sized stream of water is directed in a horizontal direction, said pin-hole sized stream of water will extend in a substantially horizontal direction for a length of at least several feet before the force of gravity draws said pin-hole sized stream of water downward to the ground, support means for supporting said water means above said ground, with said water means being oriented so that said pin-hole sized stream of water is directed in a horizontal direction, and said support means being adjustable so that the height of said pin-hole sized stream of water above said ground may be adjusted, and music means for supplying music.

* * * * *